United States Patent [19]

Okada et al.

[11] Patent Number: 4,881,474

[45] Date of Patent: Nov. 21, 1989

[54] PULVERIZED COAL COMBUSTION APPARATUS

[75] Inventors: Osamu Okada, Kure; Shigeki Morita, Hiroshima; Shigeto Nakashita, Kure; Tadahisa Masai, Ageo; Shigeru Tominaga, Hiroshima; Hiroshi Inada, Kure, all of Japan

[73] Assignee: Babcock-Hitachi Kabushiki Kaisha, Tokyo, Japan

[21] Appl. No.: 253,675

[22] Filed: Oct. 5, 1988

[30] Foreign Application Priority Data

Oct. 7, 1987 [JP] Japan ..... 62-251537
Jun. 30, 1988 [JP] Japan ..... 63-160704

[51] Int. Cl.[4] ..... F23D 1/02

[52] U.S. Cl. ..... 110/263; 110/264; 110/265

[58] Field of Search ..... 110/260–265

[56] References Cited

U.S. PATENT DOCUMENTS 4,321,034 3/1982 Taccone ..... 110/264
4,333,405 6/1982 Michelfelder et al. ..... 110/264
4,422,389 12/1983 Schroden ..... 110/264
4,545,307 10/1985 Morita et al. ..... 110/264
4,602,571 7/1986 Chadshay ..... 110/265
4,726,760 2/1988 Skoog ..... 110/265
4,748,919 6/1988 Cawpobenedetto et al. ..... 110/263

*Primary Examiner*—Henry C. Yuen
*Attorney, Agent, or Firm*—Antonelli, Terry & Wands

[57] ABSTRACT

A pulverized coal combustion apparatus comprises a burner through which pulverized coal and carrier air are passed to be burnt in a combustion chamber, and a flame retainer disposed at an end of the burner. The flame retainer includes a flared tube and an annular plate, which plate has a plurality of radially inwardly projecting parts equiangularly spaced from each other. The annular plate comprises a plurality of ceramic pieces and a plurality of fastener elements, both of which are arranged and assembled alternately to form the annular plate. Each ceramic piece is so shaped that it projects radially inwardly to serve as the projecting part when assembled. The ceramic piece has at opposite sides thereof smoothly curved edge surfaces, and the fastener element has at opposite sides thereof smoothly curved edge surfaces which are engaged with the curved edge surfaces of neighboring two ceramic pieces.

3 Claims, 8 Drawing Sheets

PULVERIZED COAL COMBUSTION APPARATUS

FIELD OF AND RELATED ART STATEMENT

The present invention relates to a pulverized coal combustion apparatus, and more particularly to a pulverized coal combustion apparatus having a specific flame retainer provided at an end of a burner therein.

Recent changes of fuel circumstances have increased the number of coal burning boilers that use coal as primary fuel, for industrial boilers such as large capacity boilers for thermoelectric power plants.

In such coal burning boilers, coal is pulverized to finely pulverized coal with a 200 mesh passing amount of, for instance, 70% by a pulverizer, thereby enhancing the combustion efficiency of coal fuel. Coal contains a large amount of nitrogen N as well as carbon C and hydrogen H. An amount of NOx generated during the combustion of the pulverized coal is larger than that of gaseous fuel or liquid fuel. Therefore, there is a demand for reducing the amount of NOx generated as much as possible.

NOx generated during the fuel combustion is substantially classified into two types, i.e., thermal NOx and fuel NOx. The thermal NOx is generated by the oxidation of nitrogen N contained in air to be burnt. The generation of thermal NOx depends largely upon the flame temperature. The higher the flame temperature becomes, the larger the amount of the thermal NOx generated becomes. On the other hand, the fuel NOx is generated by the oxidation of nitrogen N contained in the fuel. The generation of fuel NOx depends largely upon the oxygen concentration in the flame. The larger the rate of excessive oxygen becomes, the larger the amount of the fuel NOx generated becomes.

As a combustion method for restraining the generation of NOx, there have been provided various methods such as a multi-stage combustion method for supplying air in multi-stages into the combustion chamber and an exhaust gas recirculation method for introducing burnt gas of low oxygen concentration into the combustion region. Either method is intended to restrain the generation of thermal NOx by lowering the temperature of the burning flame through a low oxygen combustion.

The generation of thermal NOx can be restrained by lowering the burning temperature. However, the fuel NOx does not so depend upon the burning temperature, and then the generation of fuel NOx can not be fully restrained by lowering the burning temperature.

Accordingly, the conventional method for lowering the flame temperature is effective for the combustion of the gaseous fuel or liquid fuel that contains a small amount of nitrogen N, but is not so effective for the combustion of the pulverized coal fuel containing, in general, 1 to 2 wt. % of nitrogen.

On the other hand, the combustion of pulverized coal is composed of a thermal decomposition process of pulverized coal in which volatile components are emitted, a combustion process of the emitted volatile components and a combustion process of combustible solid components (hereinafter referred to as "char") after the thermal decomposition.

The burning rate of the volatile components is much higher than that of the solid components. The volatile components are burned in an initial stage of the combustion. Also, in the thermal decomposition process, the nitrogen contained in the pulverized coal is divided into two parts. One is emitted through volatilization in the same manner as another combustible component and the other resides in the char.

Therefore, the fuel NOx generated during the combustion of the pulverized coal is composed of NOx derived from the volatile nitrogen N and NOx derived from the nitrogen N in the char. Since the generation of fuel NOx from the char is continued during the combustion of the char, the generation of NOx is continued up to the final stage of the fuel combustion. Thus, the countermeasure measure for this is of much importance.

It is known that the volatile nitrogen N may be changed into compounds such as $NH_3$ and HCN in the initial combustion and in the combustion region of insufficient oxygen. These nitrogen compounds react not only with oxygen to change into NOx but also with NOx to decompose it into nitrogen N, as a reducing agent.

The reduction reaction due to the nitrogen compounds is developed in the co-existence system with NOx. In a system where no NOx exists, the majority of nitrogen compounds are oxidized to NOx. Also, the production of the reduced substances is likely to be advanced, as the lower oxygen concentration atmosphere is present.

As NOx reducing method upon the combustion of pulverized coal, it is effective to reduce NOx to the nitrogen N due to the nitrogen compounds by providing a co-existence NOx and the nitrogen compounds having reducivity.

In other words, by using nitrogen compounds having reductivity, such as $NH_3$ or the like that is a precursor of NOx, the amount of the generated NOx and the amount of the precursor of NOx can be decreased. This is effective for decreasing NOx.

In a conventional pulverized coal combustion apparatus, a burner is provided at an end thereof with a metal flame retainer. According to this arrangement a combustion chamber of the apparatus is provided with a reduction region, a denitration region and a complete combustion region in order along the fuel flow. Further, there is provided an oxidation region around the reduction region.

With such an arrangement, the pulverized coal is injected through the flame retainer into the combustion chamber. The retainer produces eddy flows formed inside the retainer so that the pulverized coal is entrained into the eddy flows and the air is also entrained from the outside to ensure the formation of the ignited flame.

When the reduction region is formed in the vicinity of the burner by means of the flame retainer as described above, the nitrogen oxide generated by the pulverized coal combustion is decomposed into the volatile nitrogen oxide (Volatile N) and the char contained nitrogen oxide (Char N) in the reduction region as follows.

$$\text{Total Fuel N} \rightarrow \text{Volatile N} + \text{Char N} \ldots \quad (1)$$

The volatile N contains reduction intermediate productions, for example, CO, or radicals such as $\cdot NH_2$, $\cdot CN$.

Although a small amount of NOx is locally generated in the reduction region, this is converted into a reduction radial by a hydrocarbon radical (such as $\cdot CH$) contained in the pulverized coal as shown in the formula (2).

$$NO + \cdot CH \rightarrow \cdot NH + CO \ldots \quad (2)$$

The Volatile N from the reduction region and the nitrogen ($N_2$) contained in the air are oxidized in the oxidation region, thereby producing the fuel NO and thermal NO as shown in the formulae (3) and (4).

$$2\ \text{Volatile N} + O_2 \rightarrow 2NO\ (\text{fuel NO}) \ldots \quad (3)$$

$$N_2 + O_2 \rightarrow 2NO\ (\text{thermal NO}) \ldots \quad (4)$$

In the denitration region, the NO produced in the oxidation region reacts with the reduction intermediate production (·NX) in the reduction region to produce $N_2$ to perform a self-denitrization as follows.

$$NO + NX \rightarrow N_2 + XO \ldots \quad (5)$$

where X shows $H_2$, C and the like.

In the complete combustion region, unburnt components and char containing the above-described char N are completely burnt. The char N is converted into NO at a conversion rate of about several percent. It is desirable to discharge the nitrogen N contained in the char to the gaseous phase as much as possible.

OBJECT AND SUMMARY OF THE INVENTION

The provision of the flame retainer can improve the flame retaining characteristics as described later. Therefore the low NOx combustion is achieved and the amount of the unburnt components can be reduced.

The conventional flame retainer is made of metal as described above. In general the flame temperature is high at 1,200° to 1,400° C. and the pulverized coal flows at 15 m/sec inside the retainer. There is a burning of a flame retaining plate of the retainer due to the flame temperature and there is a remarkable wear of the flame retaining plate due to collision with the pulverized coal. It is, therefore, necessary to frequently replace the flame retainer with a new one.

Accordingly, an object of the present invention is to provide a pulverized coal combustion apparatus incorporating a flame retainer having a high wear resistance and a high burning resistance.

To this end, according to the present invention, provided is a pulverized coal combustion apparatus comprising a burner through which pulverized coal and carrier medium are passed to be burnt in a combustion chamber, and a flame retainer disposed at an end of the burner, the flame retainer including a flared tube and an annular plate, which plate has a plurality of radially inwardly projecting parts equiangularly spaced from each other, wherein said annular plate comprises a plurality of ceramic pieces and a plurality of fastener elements, both of which are arranged and assembled alternately to form said annular plate, said ceramic piece is so shaped that it projects radially inwards to serve as said projecting part when assembled, and that said ceramic piece has at opposite sides thereof smoothly curved edge surfaces, and said fastener element has at opposite sides thereof smoothly curved edge surfaces which are engaged with the curved edge surfaces of neighboring two ceramic pieces of said ceramic pieces.

The other objects and the meritorious advantages of the present invention will be apparent from the following description concerning the preferred embodiments of the invention.

BRIEF DESCRIPTION OF THE DRAWINGS

FIG. 10 is a perspective view showing the primary parts shown in FIG. 9 in an assembled manner;

FIG. 11 is a longitudinal sectional view showing a general arrangement of a pulverized coal burner;

FIG. 12 is a front view showing burner; and

FIG. 13 is a schematic view showing the burning condition of the vicinity of the flame retainer.

DETAILED DESCRIPTION OF PREFERRED EMBODIMENTS

Figure 1:
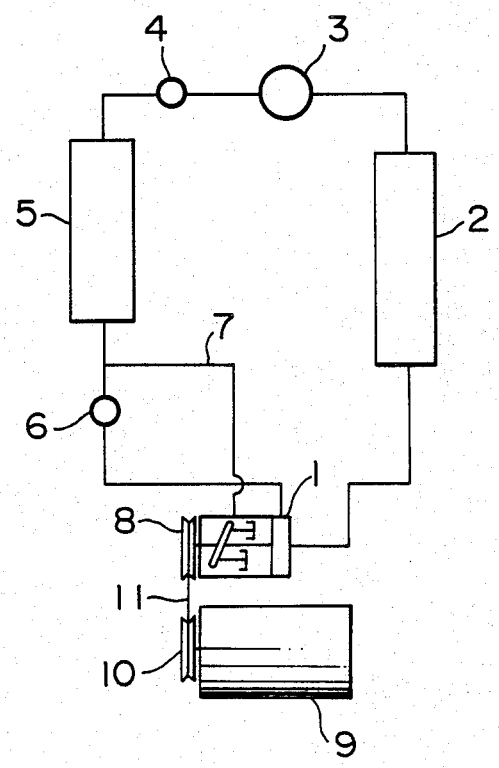
FIG. 1 is a partial enlarged view of a flame retainer according to one embodiment of the present invention.

Referring to FIG. 11, a pulverized coal burner 1 is essentially composed of a pulverized coal supply pipe 3 and a bent elbow 4. The elbow 4 has a splash plate 5 for deflecting the flow direction of mixture fluid. A pulverized coal supply passageway 6 is formed within the pulverized coal supplying pipe 3 and the elbow 4. Injected through the supply passageway 6 into a combustion chamber 2 is a mixture fluid of the pulverized coal and a primary air, or a mixture fluid of the pulverized coal and exhaust gas, or a mixture fluid of the pulverized coal, the primary air and the exhaust gas.

For the purpose of supplying the combustion air from a wind box 7 to a burner port 9 of a chamber wall 8, a partitioning plate 10 and a sleeve 11 are provided around the outer periphery of the pulverized coal supply pipe 3. The wind box 7 is partitioned to define a secondary air passageway 12 and a third air passageway 13. A secondary vane 14 and a third air resister 15 are disposed in the secondary air passageway 12 and the third order air passageway 13, respectively. The flow rates of the combustion air passing through the secondary air passageway 12 and the third order air passageway 13 are respectively controlled by such vane.

At a front end of the pulverized coal burner 1, there is provided a flame retainer 18 composed of an annular plate 16 and a flared tube 17 incorporating therein the annular plate 16. The annular plate 16 has a plurality of projecting parts equiangularly spaced from each other, each of which projects radially inwards. As shown in FIGS. 11 to 13, the annular plate 16 further has at a central portion thereof an opening 19 through which the mixture fluid passes towards the combustion chamber 2.

The flame retainer 18 is used to restrain the pulverized coal from diffusing radially outwards of the pulverized coal burner 1. At the same time, as shown in FIG. 13, the retainer 18 generates eddy flows 20, thereby enhancing the ignitability and the flame retaining effect.

The retainer 18 cooperates with an end portion of the sleeve 11 in directing the secondary air in the secondary air passageway 12 and the third air in the third air passageway 13 radially outwards as much as possible.

With such an arrangement, the pulverized coal is injected through the opening 19 of the flame retainer 18 into the chamber 2. As shown in FIG. 13, the eddy flows 20 formed by the retainer 18 entrains the pulverized coal and leads the air into a center portion of the chamber 2 to form the ignited flame.

As described hereinbefore, the flame retainer 18 is subjected to the flame of higher temperature, e.g. 1,200° C. to 1,400° C., and to collision with the pulverized coal with a higher speed. The flame retainer may be affected in the burning lost and the wear. Therefore, according to this embodiment, the annular plate 16 is composed of a plurality of ceramic pieces 23 and a plurality of metal fasteners 25 which are disposed alternately. They are engaged with each other and assembled into the annular plate 16. When assembled, the ceramic pieces 23 project towards a center of the opening 19 of the annular plate 16, so that the eddy flows 20 are formed.

Figure 3:
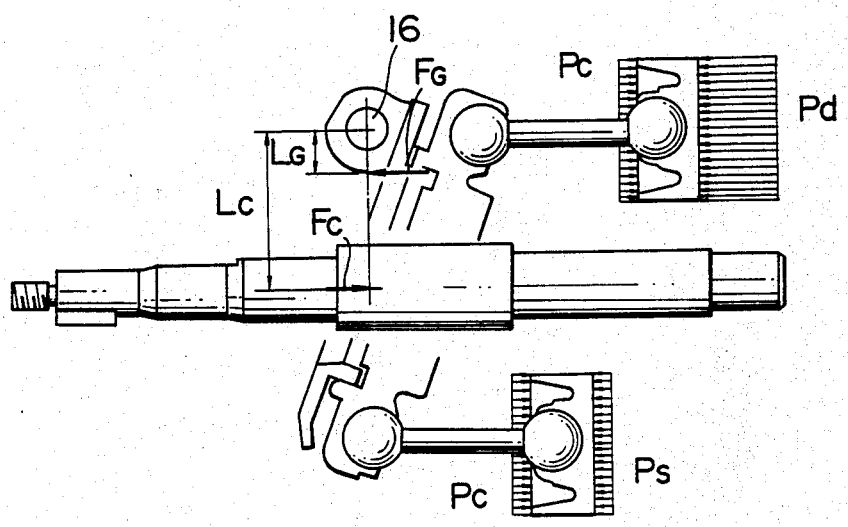
FIGS. 3A and 3B are frontal views of the ceramic piece and the metal fastener of the retainer shown in FIG. 1.

As shown in FIGS. 3A and 3B, the ceramic piece 23 is made of $Si_3N_4$ (silicon nitride) or SiC (silicon carbide). The ceramic piece 23 has at opposite sides thereof recesses **24*a* and projections 24*b*. The metal fastener 25 is made of, for example, stainless steel (SUS310S) The fastener 25 has at opposite sides thereof projections 26*a* and recesses 26*b***.

As shown in FIG. 1, the metal fastener 25 is fitted at the projections **26*a*, 26*a* thereof into the ceramic pieces 23, 23 at the recesses 24*a*, 24*a* thereof. Also, the metal fastener 25 is fitted at the recesses 26*b*, 26*b* thereof into the ceramic pieces 23, 23 at the projections 24*b*, 24*b*** thereof.

Thus, the ceramic piece 23 and the metal fasteners 25 are combined in an alternate manner with each other, whereby each ceramic pieces 23 is clamped on both sides thereof by the metal fasteners 25, 25 to prevent the ceramic pieces 23 from falling away. The metal fasteners 25, 25 are fixed to the flared tube 17 by means of bolts 22.

Figure 2:
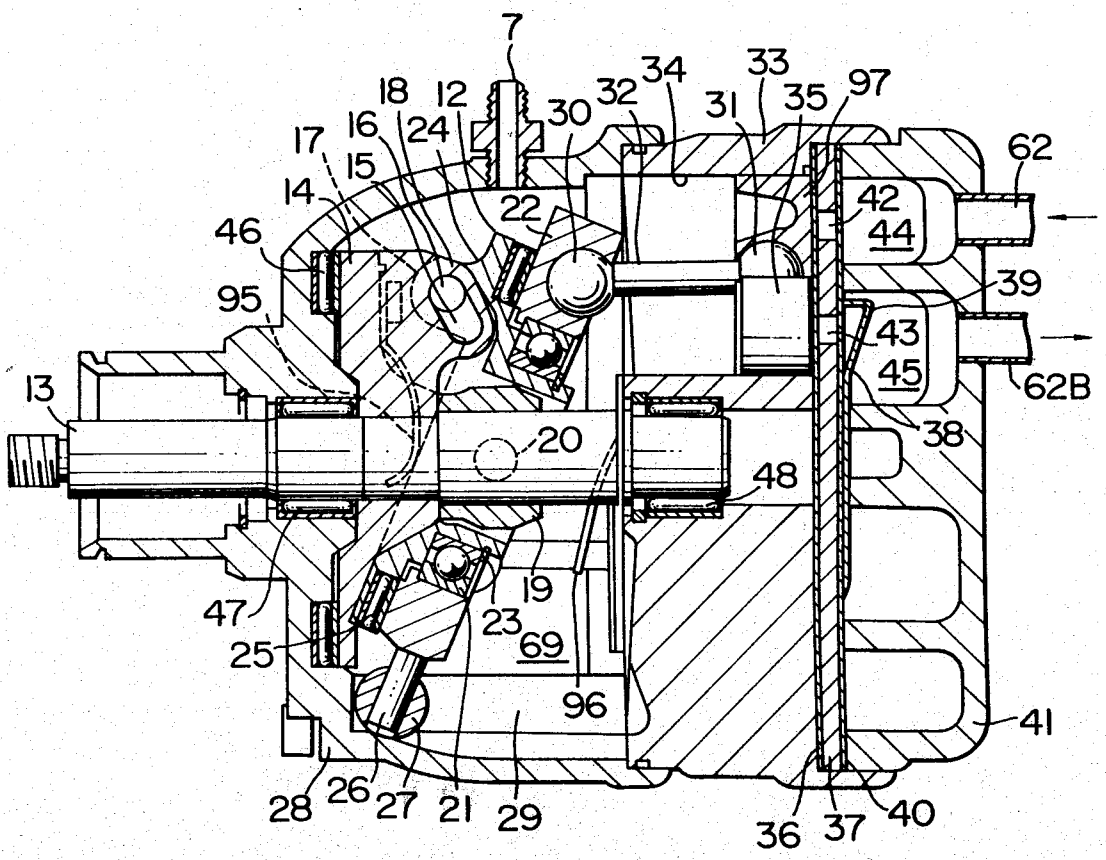
FIG. 2 is a longitudinal sectional view showing a pulverized coal burner incorporating the retainer shown in FIG. 1.

As shown in FIG. 2, a ceramic ring 27 is provided in the flared tube 17 The ceramic ring 27 is positioned radially inwards of the flame retainer 18 so as to serve as a liner for the metal fasteners 25.

Figure 4:
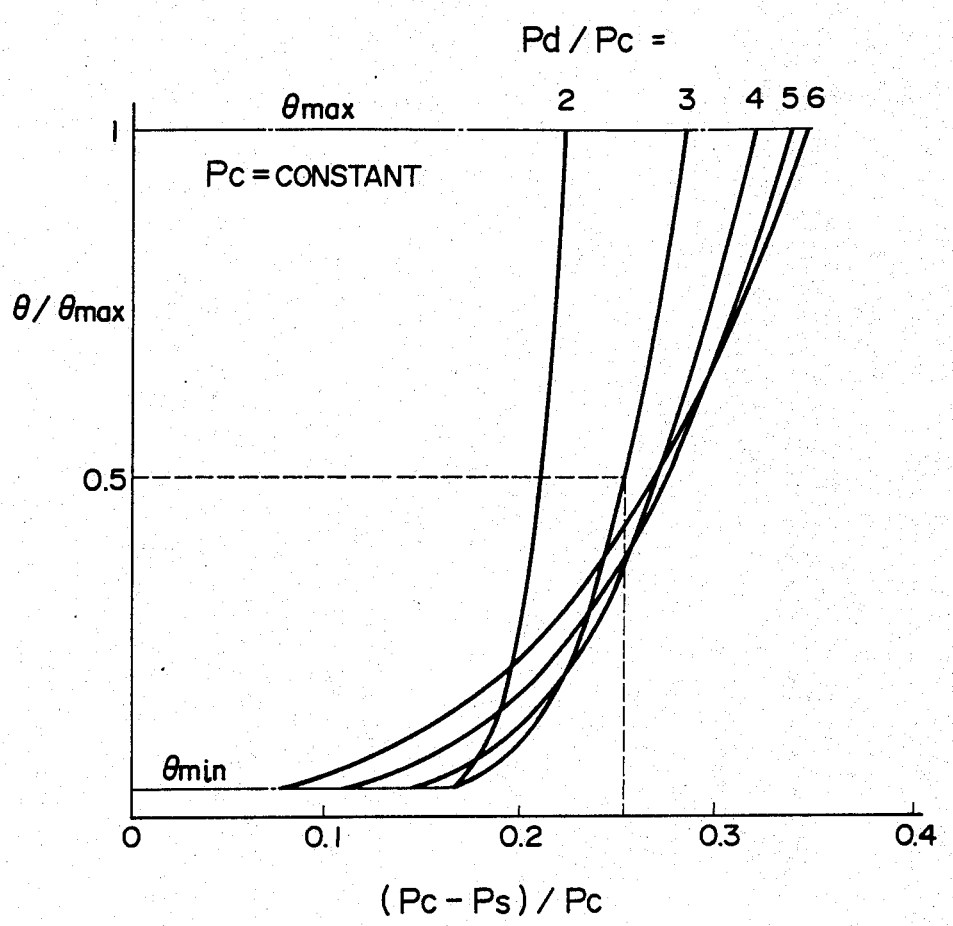
FIG. 4 is an exploded perspective view showing the primary parts; of the retainer shown in FIG. 1.
Figure 5:
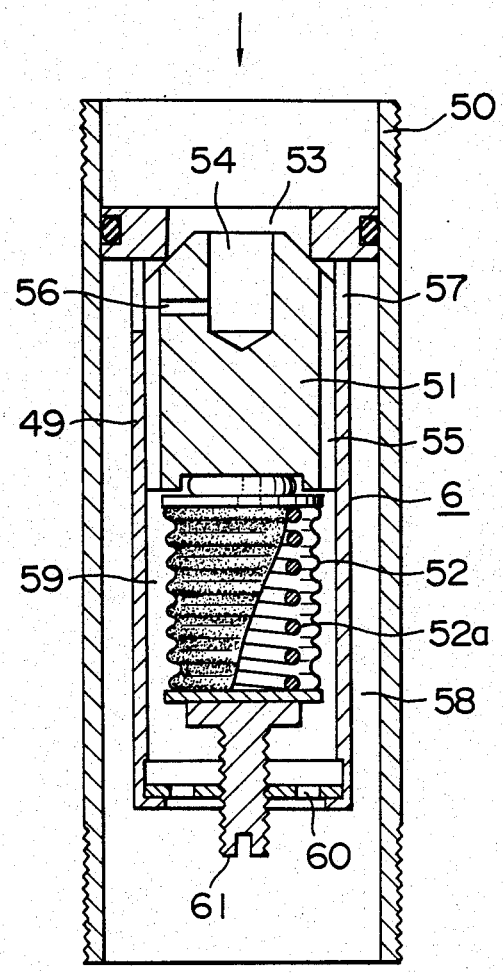
FIG. 5 is a perspective view showing the primary parts shown in FIG. 4 in an assembled manner.

In order to prevent the ceramic ring 27 and the annular plate 16 from axially moving, a stopper ring 28 is welded to the tube 17 (see FIGS. 4 and 5). The ceramic ring 27 and the annular plate 16 are clamped and held between the front end of the pulverized coal supply pipe 3 and the stopper ring 28.

The ceramic pieces 23 and the ceramic ring 27 are used at the end portion of the flame retainer 18 which is most likely to be worn. The pulverized coal deflected flow due to the eddy flows 20 collides with the ceramic pieces 23 and the ceramic ring 27. However, the wear resistance and the burning resistance of such ceramics can fully withstand out against the pulverized coal collision.

If shock absorbing material such as ceramic paper is interposed between the metal fastener 25 and the ceramic piece 23, and between the ceramic ring 27 and the flared tube 17 and the metal fasteners 25, it is possible to avoid the direct contact between the metal fasteners 25 and the ceramic pieces 23 and the ceramic ring 27.

The metal fasteners 25 and the flared tube 17 are coupled by means of the bolts 22, so that the fastening forces of the bolts 22 are not applied directly to the ceramic pieces 23.

As described above, the annular plate 16 is assembled by alternatively combining the ceramic pieces 23 and the metal fasteners 25 in a ring shape. The metal fasteners 25 are expanded more than the ceramic pieces 23 due to the heat of the flame, i.e., the thermal stress appears therebetween. However, since each of the ceramic pieces 23 and the metal fasteners 25 is provided with the convex portions (arcuate projections **24*b*, 26*a*) and the concave portions (arcuate recesses 24*a*, 26*b*), there is a small stress concentration at the engagement portion and there is almost no fear that the ceramic pieces 23** would be damaged.

FIGS. 6 to 10 show another embodiment of the invention. There are two differences between the first embodiment and this embodiment. Namely, first, flange portions 29, 29 are formed integrally with both sides of the metal fastener 25, instead of the stopper ring 28.

Figure 6:
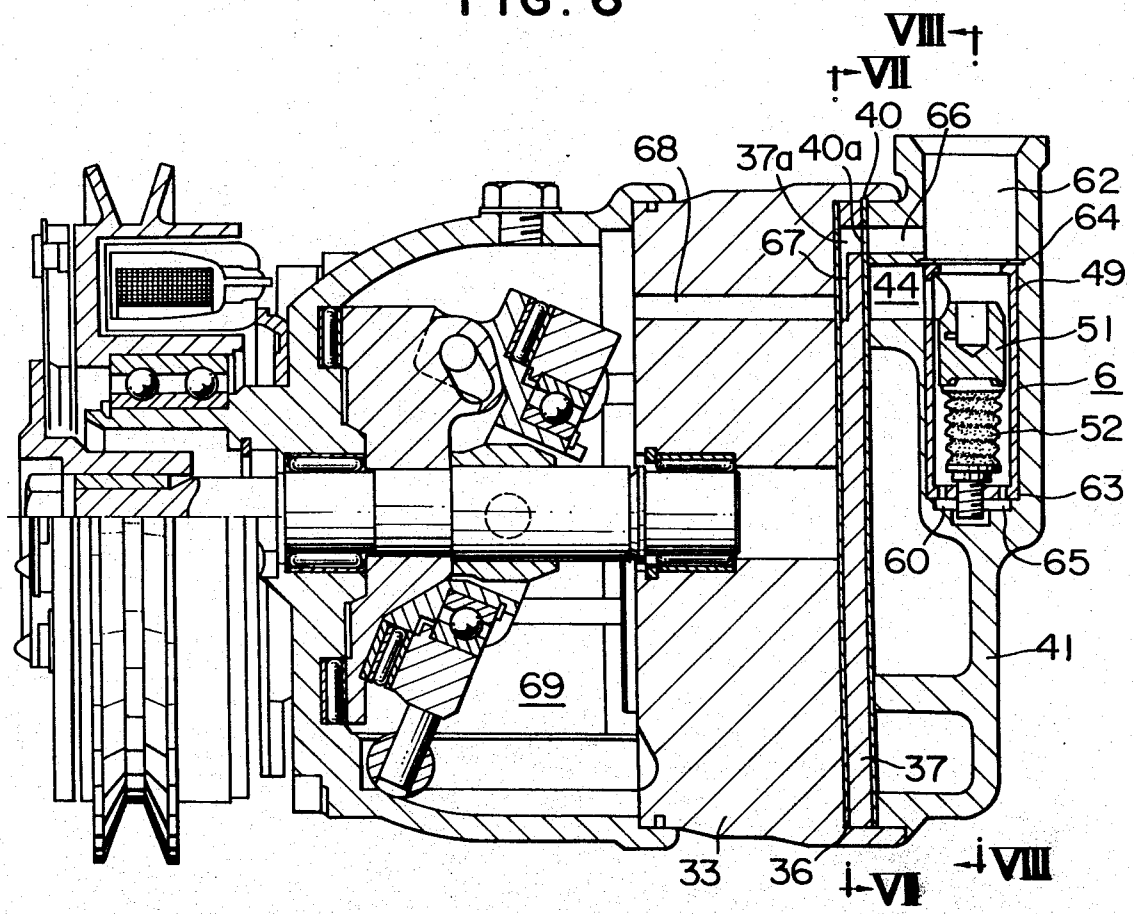
FIG. 6 is a partial enlarged front view showing a flame retainer according to another embodiment of the present invention.
Figure 7:
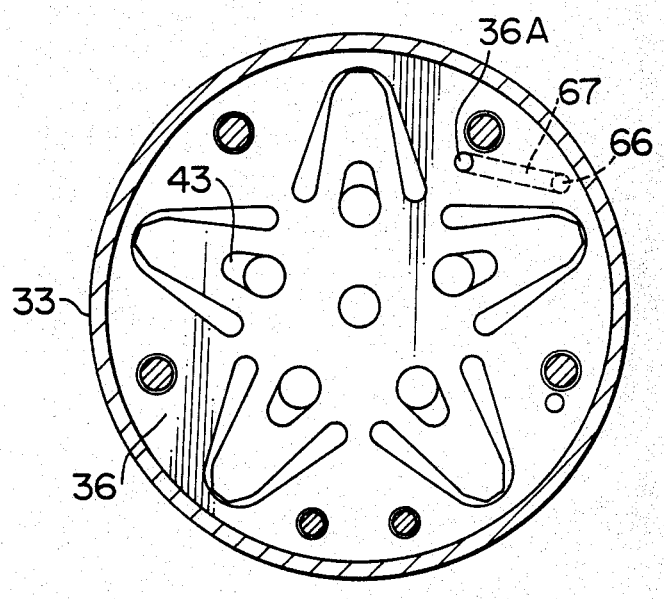
FIG. 7 is a plan view showing the metal fastener shown in FIG. 6.
Figure 8:
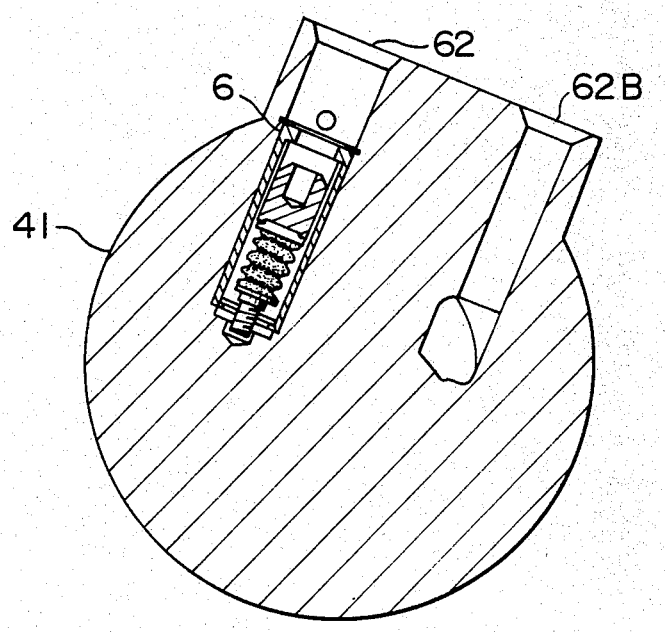
FIG. 8 is a longitudinal sectional view showing a pulverized coal burner incorporating the retainer shown in FIG. 6.
Figure 9:
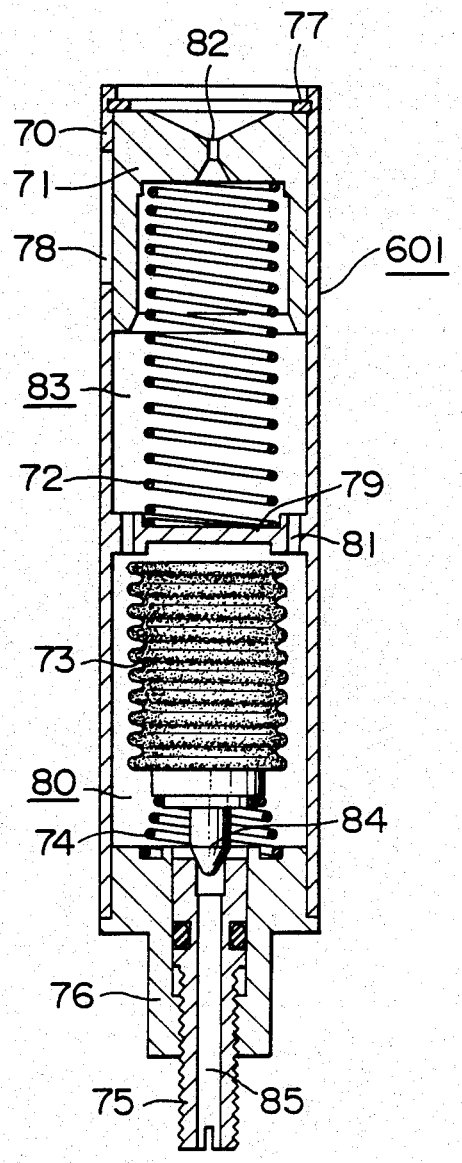
FIG. 9 is an exploded perspective view showing the primary parts of the retainer shown in FIG. 6.

As shown in FIGS. 6 and 10, when assembled, the flange portions 29, 29 are engaged with an end faces of the ceramic pieces 23 for preventing the ceramic pieces 23 from displacing toward the chamber. Since the flange portions 29 are formed integrally with the metal fasteners 25, there is no fear that a gap due to the deformation would be formed between the ceramic pieces 23 and the flange portions 29.

In the case of the first embodiment, when the flared tube 17 is heated due to the radiation heat from the flame, the flared tube 17 is thermally deformed due to the temperature difference between the inner and outer portions thereof, as a result of which a gap would be formed between the ceramic pieces 23 and the metal stopper ring 28 or between the ceramic ring 27 and the ceramic pieces 23. Thus, burnt ashes would enter into the gap. Under such a condition, when the burner is cooled, the tube 17 is returned back to the original condition, but the burnt ashes that have been introduced into the gap serve as a fulcrum, so that a bending stress is generated in the ceramic pieces 23 by the stopper ring 28 to cause damage. In contrast, according to the second embodiment, since the flange portions 29 are formed integrally with the metal fasteners 25, the defects inherent in the first embodiment may be overcome.

The materials to be used in the ceramic pieces 23, the ceramic ring 27 and the like will be explained hereinunder.

It is possible to use, as the ceramic materials, for example, aluminum oxide, silicon dioxide, magnesium oxide, zirconium oxide, spinel ($MgO \cdot Al_2O_3$), mullite ($3Al_2O_3 \cdot 2SiO_3$), carbon silicate, boron carbide, aluminum nitride, silicon nitride, titanium nitride and the like. It is preferable to use silicon nitride and silicon carbide.

In the case where the ceramic materials are used for the ceramic pieces 23 and the ceramic ring 27, the following conditions must be considered.

(1) Hardness

The ceramic materials to be used must have a sufficient hardness in comparison with a conventional burner wear-resistant material (for example, wear-resistant cast steel).

(2) Bending Strength

The ceramic materials to be used must have a sufficient resistance against the external forces such as fastening force at each part.

(3) High Temperature Strength

Although the portion close to the burner end is kept at a rather high temperature due to the radiation heat from the chamber, the ceramic material to be used must have a predetermined mechanical strength under such a high temperature condition.

(4) Thermal Shock Resistance

The ceramic materials to be used must have a sufficient mechanical strength against the thermal shock generated in the transient process such as a burner inoperative condition from the high temperature condition (due to the radiation heat from the chamber) to the cooling condition at ignition (due to the pulverized coal flow containing the primary air).

(5) Heat Resistance

The ceramic materials to be used must withstand the strong radiation heat from the chamber.

The various properties of each material will be explained, in respect of:

1. Vickers Hardness (load: 500 g);
2. Bending Strength;
3. High Temperature Strength (1,000° C. or less);
4. Thermal Shock Resistance (Heat a test piece to 400° C. then emerge it into water to be subjected to the thermal shock. Thereafter, measure a bending strength thereof); and
5. Maximum Use Temperature.

SILICON NITRIDE

1. Vickers hardness: 1,780 (kg/mm$^2$),
2. Bending Strength: 6,000 (kg/cm$^2$),
3. High Temperature Strength: 5,500 (kg/cm$^2$),
4. Thermal Shock Resistance: 6,000 (kg/cm$^2$),
5. Maximum Use Temperature: 1,200 (°C.)

SILICON CARBIDE

1. Vickers Hardness: 2,000 (kg/mm$^2$)
2. Bending Strength: 5,500 (kg/cm$^2$)
3. High Temperature Strength: 5,500 (kg/cm$^2$)
4. Thermal Shock Resistance: 5,500 (kg/cm$^2$)
5. Maximum Use Temperature: 1,200 (°C.)

ALUMINA

1. Vickers Hardness: 1,670 (kg/mm$^2$)
2. Bending Strength: 3,180 (kg/cm$^2$)
3. High Temperature Strength: 2,200 (kg/cm$^2$)
4. Thermal Shock Resistance: (impossible to measure due to fracture)
5. Maximum High Use Temperature: 1,590 (°C.)

HEAT RESISTANT CAST STEEL

1. Vickers Hardness: 600 (kg/mm$^2$)
5. Maximum High Use Temperature: 790 (°C.)

As is apparent from the results, the silicon nitride and the silicon carbide are preferable materials that satisfactorily meet the above-described conditions 1 to 5.

According to the present invention, since the annular plate that is most likely to be subjected to the wear and burning damage may be made of ceramics, it is possible to prevent the annular plate from being worn and burnt.

What is claimed is:

1. A pulverized coal combustion apparatus comprising a burner through which pulverized coal and carrier medium are passed to be burnt in a combustion chamber, and a flame retainer disposed at an end of said burner, said flame retainer including a flared tube and an annular plate, which plate has a plurality of radially inwardly projecting parts equiangularly spaced from each other, wherein said annular plate comprises a plurality of ceramic pieces and a plurality of fastener elements, both of which are arranged and assembled alternately to form said annular plate, said ceramic piece being so shaped that is projects radially inwardly to serve as said projecting part when assembled, and said ceramic piece having at opposite sides thereof smoothly curved edge surfaces, and said fastener element having at opposite sides thereof smoothly curved edge surfaces which are engaged with the curved edge surfaces of neighboring two ceramic pieces of said ceramic pieces.

2. An apparatus according to claim 1, wherein said fastener element further comprises at opposite sides thereof flange portions integrally formed on said fastener element, each of said flange portions being engaged with an axial end surface of the neighboring ceramic piece, which end surface faces to said combustion chamber.

3. An apparatus according to claim 1, wherein said retainer further comprises a ceramic ring disposed within said annular plate, with which said annular plate is lined.

* * * * *